US008250820B2

(12) United States Patent
Joret et al.

(10) Patent No.: US 8,250,820 B2
(45) Date of Patent: Aug. 28, 2012

(54) SEMI-CURTAIN FACADE

(75) Inventors: Laurent Joret, Velizy (FR); Marie-Isabelle Watchi, Nice (FR); Harold Hugonenc, Gentilly (FR)

(73) Assignee: Saint-Gobin Isover, Courbevoie (FR)

( * ) Notice: Subject to any disclaimer, the term of this patent is extended or adjusted under 35 U.S.C. 154(b) by 36 days.

(21) Appl. No.: 12/808,825

(22) PCT Filed: Dec. 18, 2008

(86) PCT No.: PCT/FR2008/052358

§ 371 (c)(1),
(2), (4) Date: Sep. 29, 2010

(87) PCT Pub. No.: WO2009/081049

PCT Pub. Date: Jul. 2, 2009

(65) Prior Publication Data

US 2011/0030296 A1 Feb. 10, 2011

(30) Foreign Application Priority Data

Dec. 19, 2007 (FR) ..... 07 60031

(51) Int. Cl.
*E04H 14/00* (2006.01)

(52) U.S. Cl. ..... 52/235; 52/236.3

(58) Field of Classification Search ..... 52/235, 52/236.3, 404.2, 481.1
See application file for complete search history.

(56) References Cited

U.S. PATENT DOCUMENTS

| | | | | |
|---|---|---|---|---|
| 4,078,348 | A | 3/1978 | Rothman | |
| 4,372,089 | A * | 2/1983 | Akesson | 52/404.3 |
| 4,570,400 | A * | 2/1986 | Slager et al. | 52/235 |
| 6,279,284 | B1 * | 8/2001 | Moras | 52/408 |
| 2006/0179745 | A1 | 8/2006 | Lysyuk | |
| 2008/0148659 | A1 * | 6/2008 | Schiffmann et al. | 52/272 |
| 2008/0178782 | A1 * | 7/2008 | Frobosilo et al. | 109/78 |

FOREIGN PATENT DOCUMENTS

| | | |
|---|---|---|
| EP | 0 320 359 | 6/1989 |
| EP | 1 533 431 | 5/2005 |
| EP | 1 712 694 | 10/2006 |

OTHER PUBLICATIONS

International Search Report issued Nov. 10, 2009 in PCT/FR08/52358 filed Dec. 18, 2008.

* cited by examiner

*Primary Examiner* — Brian Glessner
*Assistant Examiner* — Paolo Agudelo
(74) *Attorney, Agent, or Firm* — Oblon, Spivak, McClelland, Maier & Neustadt, L.L.P.

(57) ABSTRACT

A building facade including an exterior envelope including facade elements, a rain barrier, profiled holding and supporting elements fixed vertically to floor edges, a thermal insulation system including a first insulating element in front of floor edges and a second insulating element on the inside, between floors, a vapor barrier, and an interior lining. The first insulating element is basically continuous across the surface of the facade, or is essentially free of air pockets, two adjacent breadths of the first insulating element being separated by a flat surface of the profiled elements projecting forwards of the floor edges.

12 Claims, 8 Drawing Sheets

SEMI-CURTAIN FACADE

The present invention relates to facades for buildings.

BACKGROUND

Many facades are currently made in masonry using small elements, and/or concrete casing formwork.

These facades are relatively heavy and in some cases difficult to produce.

They do not provide satisfactory treatment of the thermal bridges at the interfaces with the structure and at particular points (balconies, loggias, changes in the direction of the wall and so forth), either in terms of interior or exterior thermal insulation.

When the building comes to the end of its life, these facades necessarily have to be demolished since there is no way of dismantling them.

Attempts to develop lightweight facades such as semi-curtain walling have so far failed to satisfy all of the following requirements:

- thermal bridges must be limited to a reasonable level,
- both opaque and glazed parts must be integrated,
- they must be adequately watertight and airtight,
- they must be adaptable to different types of construction, and
- construction costs must be contained.

These problems have been solved by the present invention which, in particular:

- enables the whole of the facade of the building to be treated, including opaque parts and glazed parts,
- produces a facade which can be totally (and hence still more partially) dismantled, and
- is particularly advantageous in terms of cost, both in construction and use.

Excellent levels of thermal and acoustic insulation can be achieved.

SUMMARY OF THE INVENTION

To this end, the invention relates to a building facade comprising essentially, and in the following order:

- an exterior envelope made of facade elements,
- a rain barrier,
- profiled holding and supporting elements fixed vertically to floor edges,
- a thermal insulation system comprising a first insulating element in front of the floor edges and a second insulating element on the inside, between floors,
- a vapor barrier, and
- an interior lining, said building facade being provided such that the first insulating element is basically continuous across the surface of the facade, and essentially free of air pockets. Two adjacent breadths of the first insulating element are separated by a flat surface of the profiled elements projecting forwards of the floor edges.

The type of facade elements used for the exterior envelope is not limited. They may for example be metal wall cladding (sheet metal, optionally corrugated, etc.) or a timber facing. These facade elements, or in other words this exterior facing, are advantageously fixed to vertical profiled elements (which may for example be Z sections) which are themselves fixed to said profiled elements above the rain barrier. In other embodiments the vertical profile elements may also be fixed to a horizontal framework fixed to these vertical profiled elements or vertical Z sections. An air gap occupies the full depth of the Z sections, for example 2 cm.

An air gap advantageously at least 2 cm thick is thus created between the rain barrier and the outer facing (allowing for vertical air circulation), in the volume corresponding to the depth of the vertical profiled elements to which the exterior facing is fixed.

The rain barrier, which is a flexible plastic sheet, is fixed to the exterior face of said profiled elements. Alternatively a sheet of timber or OSB (Oriented Strand Board), or equivalent, may be inserted between profiled elements and rain barrier, to improve the acoustic performance of the facade.

The profiled elements are fixed to the floor edges by any suitable method, a particularly practical method being from the outside, several forms of which will be detailed later.

The first insulating element preferably occupies virtually the entire volume corresponding to the depth of the profiled elements. There is no need for the thickness of insulating element to be exactly the same as the depth of said profiled elements, but it is essential that the surface of the facade be covered by as continuous as possible a layer of insulating material. The layer of the first insulating material is thus interrupted, between two adjacent breadths, only by the thickness of a thin wall, perpendicular to the facade, of said profiled elements.

The possibilities of arranging the second between floors interior insulating element, the vapor barrier and said lining, creating an interior insulation system, are multiple, and several examples will be detailed below.

The building facade of the invention offers very good mechanical properties, at the level currently required in terms of impact resistance, or relative to cleaning cradles for example, or to the effects of earthquakes in the case of residential buildings situated in medium-risk zones and where the height does not exceed 28 meters, in particular.

Opaque and glazed parts are both easily accommodated, and it is very easy to apply the present invention to the most varied types and styles of construction.

Airtightness, produced by applying an independent vapor barrier film, is good, while excellent thermal and acoustic insulation can be achieved.

The facade of the invention is easy to dismantle and its cost of manufacture is moderate.

The profiled elements preferably have

- a flat rear surface for contact with at least one floor edge and for contact with and/or attachment to an interior insulation system,
- a flat front surface for the support and attachment to the rain barrier, and thereby for the support of the facade elements, and
- a flat middle surface which joins the flat rear and front surfaces.

In a simple and practical embodiment, the flat rear and front surfaces are in planes parallel to the main plane of the facade, and the flat middle surface is in a vertical plane perpendicular to said main plane. This means that breadths of insulating elements of generally parallelepiped shapes can be installed on either side of said flat middle surface to maximize the space occupied by the insulating element.

In a first variant of this particular embodiment, only the flat rear surface is on one side of the plane of the flat middle surface. Said flat middle surface can thus easily be fixed, by screws, for example, to a bracket on the opposite face of said flat middle surface from that with the flat rear surface. This fixing is easily done from the outside of the building, the bracket having previously been fixed to the floor edge in the same way.

Three particularly practical embodiments of the first variant may be mentioned.

In the first embodiment, said flat front surface is positioned on the same face of the flat middle surface as the flat rear surface: the profiled element is basically U or C shaped (the edges of the profiled element are bent into flanges).

In the second embodiment, said flat front surface is positioned only on the opposite face of the flat middle surface from that with the flat rear surface: the profiled element may be approximately a Z (two adjacent arms of the Z being perpendicular).

In the third embodiment, the flat front surface is positioned on both faces of the flat middle surface.

In a second variant, which can be combined with the first variant, said profiled elements are shaped elements, or differ from an H shape only by the absence of one end part. This brings us back in particular to the shapes of the three embodiments of the first variant.

The H profiled elements can easily be fixed to the floor edges from the outside. All that is required is to first fix to the floor edge a fixing bracket having a first part to be fixed to the flat middle surface of a first H profiled element (upper) and a second part to be fixed to the flat middle surface of the second H profiled element (lower). Said flat front surface of each profiled element covers one of the two lateral edges of a panel or breadth of said first insulating element, or two such lateral edges of adjacent panels or breadths.

The above described profiled elements are made from any material offering the high mechanical properties required at reasonable thicknesses and weights: a metal, especially aluminum, and preferably a reinforced plastic may be mentioned. Reinforced plastic has excellent mechanical properties in profiled elements within wall cross sections, good insulating performance, solving the problem of thermal bridges at the floor edges, and good fire properties. These advantages will be detailed later.

The profiled elements are advantageously made of pultruded resin and glass fiber composite, which may in particular be continuous and/or in the form of mats. The resin employed may be an acrylic, polyester, vinylester or epoxy resin.

These materials offer the required mechanical properties.

They are excellent thermal insulators—with a thermal conductivity of around 0.2 W/mK, they are a good solution to the thermal bridge problems. They are also excellent electrical insulators.

They have very good fire resistance, are self-extinguishing, and do not emit toxic fumes in the event of fire, in the case of many of them.

To give an indication, the thickness of the walls of the profiled elements is around 4 to 10 mm, which in particular gives satisfactory continuity of the insulating layer created by the juxtaposition of breadths of insulating elements on either side of said middle wall.

Said first and second insulating elements are preferably selected from inorganic fiber-based insulating materials such as glass wool, rock wool, plant fibers such as hemp, flax and cotton wool, or fibers of animal origin such as sheep's wool.

Said interior lining is preferably based on a plasterboard sheet (of type BA 25 or thicker) or multiple superposed such sheets (at least two BA 13, etc.).

The invention also relates to an assembly of components as described above for making such a facade.

DETAILED DESCRIPTION OF THE PREFERRED EMBODIMENTS

Figure 1:
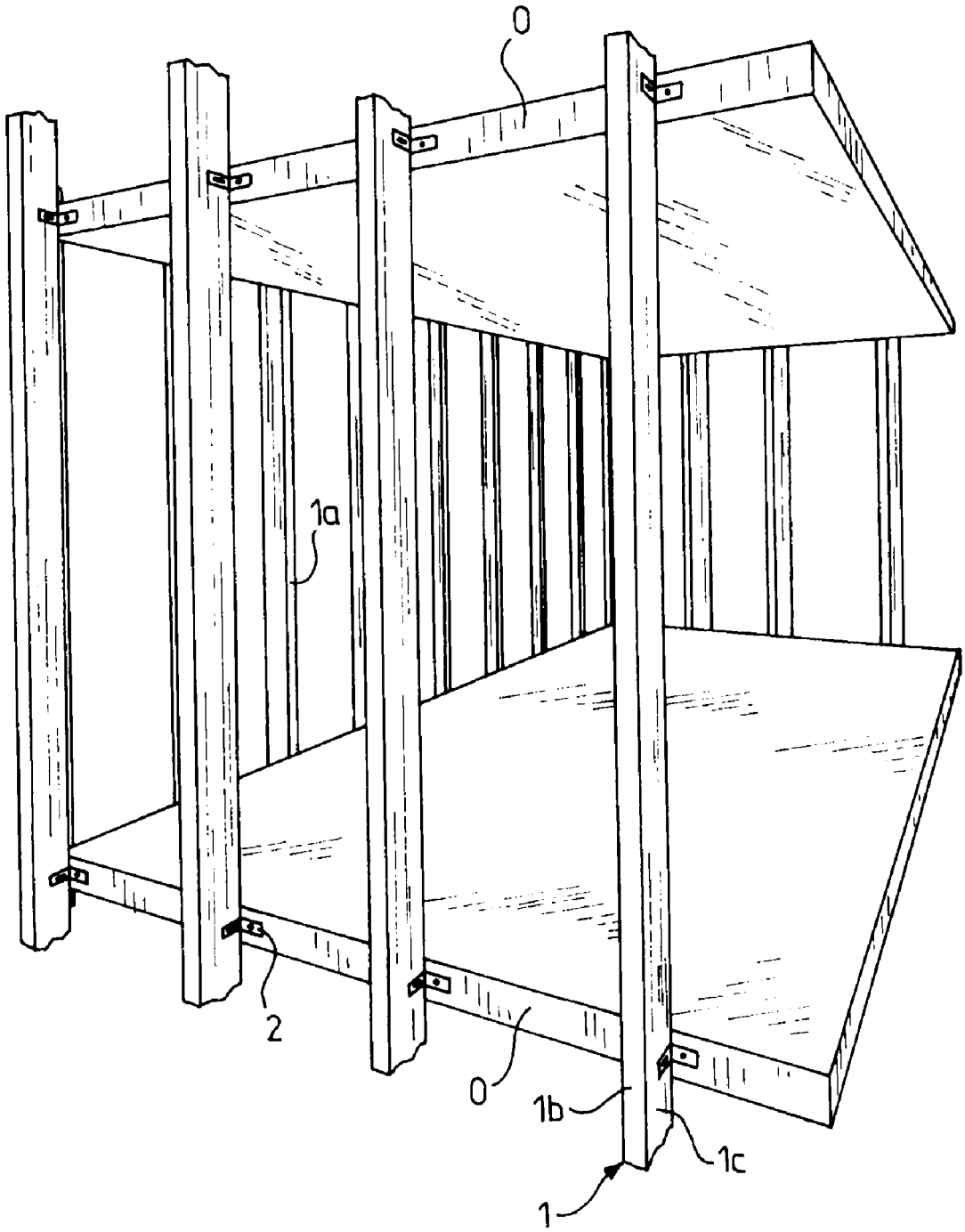
FIGS. 1-8 show diagrammatically in perspective, the successive stages in constructing a facade according to the invention.

FIG. 1 shows two adjacent floor edges 0. It should be noted however, that the facade of the present invention is perfectly suitable for a structure with a larger number of floors.

Profiled elements 1 are fixed vertically at regular intervals of 600 mm to the floor edges 0.

The profiled elements 1 are U-shaped: each has a concavity which is not visible and which is situated, in the case of the profiled elements nearest the viewer, on the left-hand side.

Each profiled element 1 has a flat rear surface 1*a* and a flat front surface 1*b* parallel to the latter. These are joined together by a perpendicular flat middle surface 1*c*. The latter is about 120 mm wide and is 6 mm thick.

The profiled elements 1 may be made of polyester resin reinforced with continuous glass fibers, and glass fiber mats.

The profiled elements 1 are fixed to the floor edges 0 by brackets 2. The floor edges 0 do not have to be exactly plumb with each other, so this mode of fixing the profiled elements 1 is compatible with no contact between these elements 1 and a floor edge 0, i.e. with a non-zero—but small—distance between a profiled element 1 and a floor edge 0.

The brackets 2 are made of metal or reinforced plastic. They are screwed both into a floor edge 0 and into a flat middle surface 1*c* of a profiled element 1.

Figure 2:
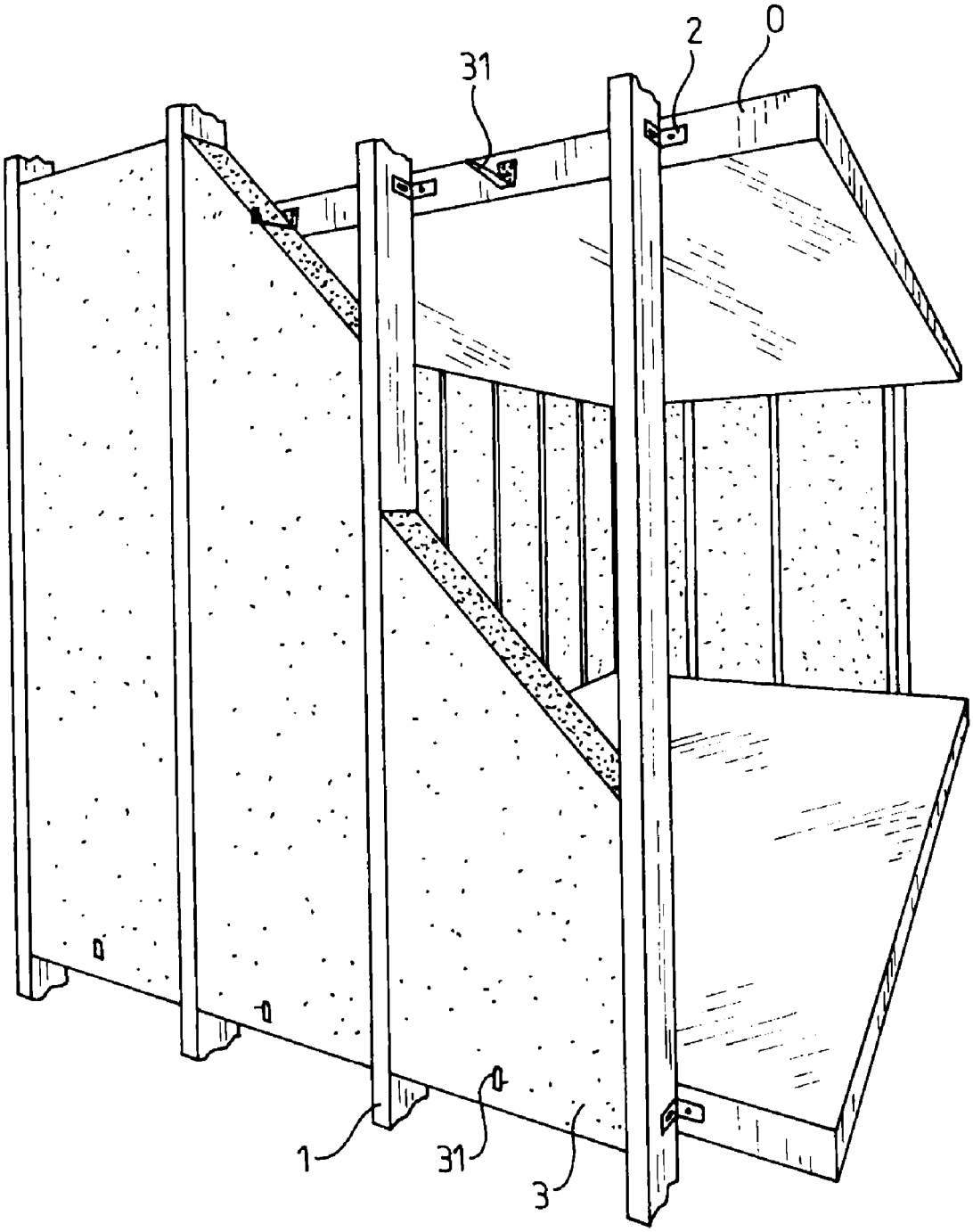

FIG. 2 shows the application of insulating material 3 occupying the full space defined by the depth of the profiled elements 1.

The insulating material 3 consists of 120 mm thick panels of glass wool sold by Saint-Gobain Isover under the name Panolène Facade. This glass wool has a thermal conductivity of 0.032 W/mK.

The glass wool is inserted into the concavity of the U-profiled elements 1. When presented to the floor edges 0, it is first stuck on spikes 31 fixed to the floor edges 0. The spikes 31 are bent up on the outside of the glass wool 3 when the glass wool 3 is in place.

Figure 3:
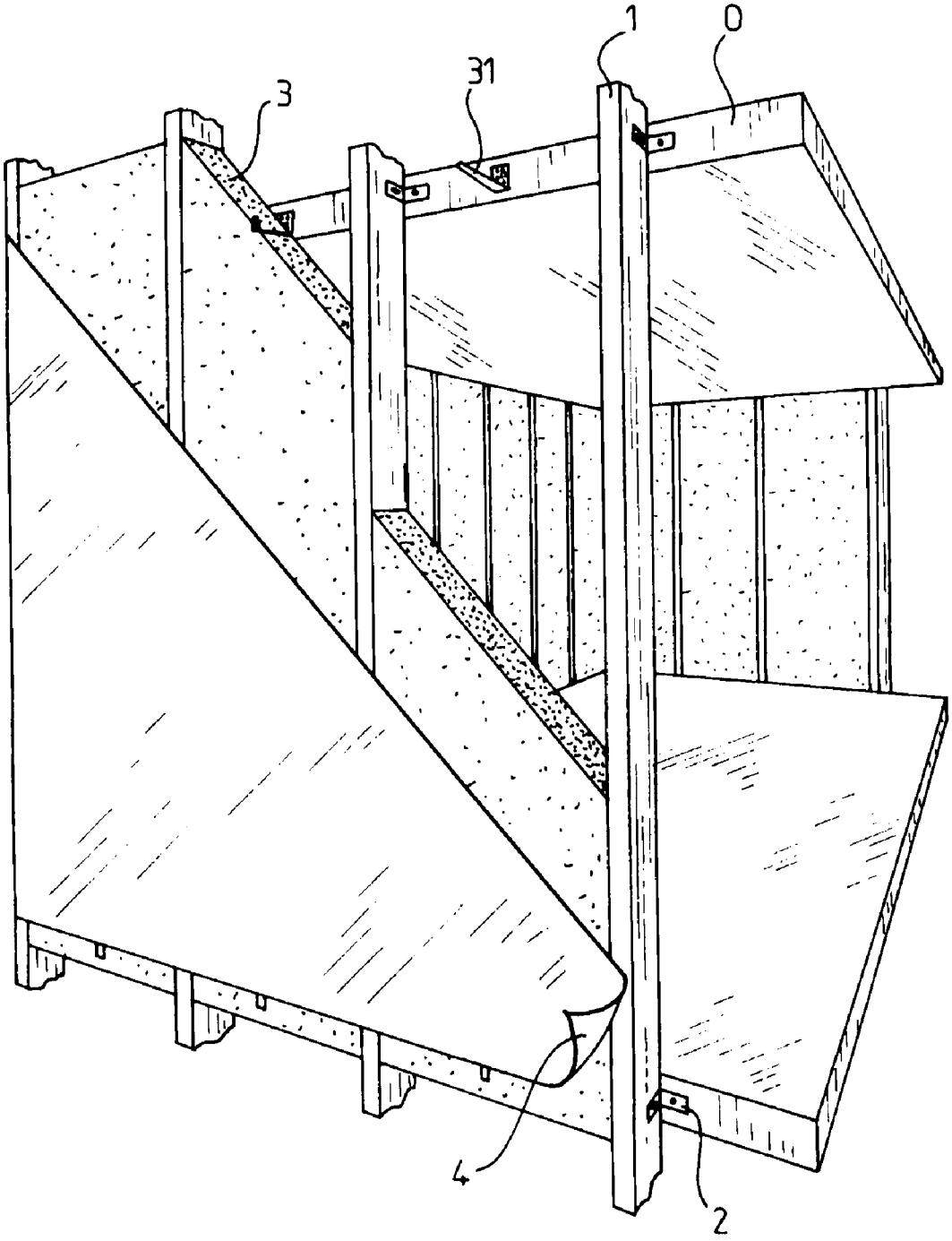

A rain barrier 4 is then applied to said flat front surfaces 1*b* of the profiled elements 1, on top of the insulating material 3—see FIG. 3. The rain barrier is, as in the prior art, a flexible plastic sheet, sold for example by Doerken Delta Fassade.

The exterior covering the facade, although part of the system of the invention, has no special features and is not described in any greater detail here.

The construction of an internal insulation for a facade according to the invention will now be described.

Figure 4:
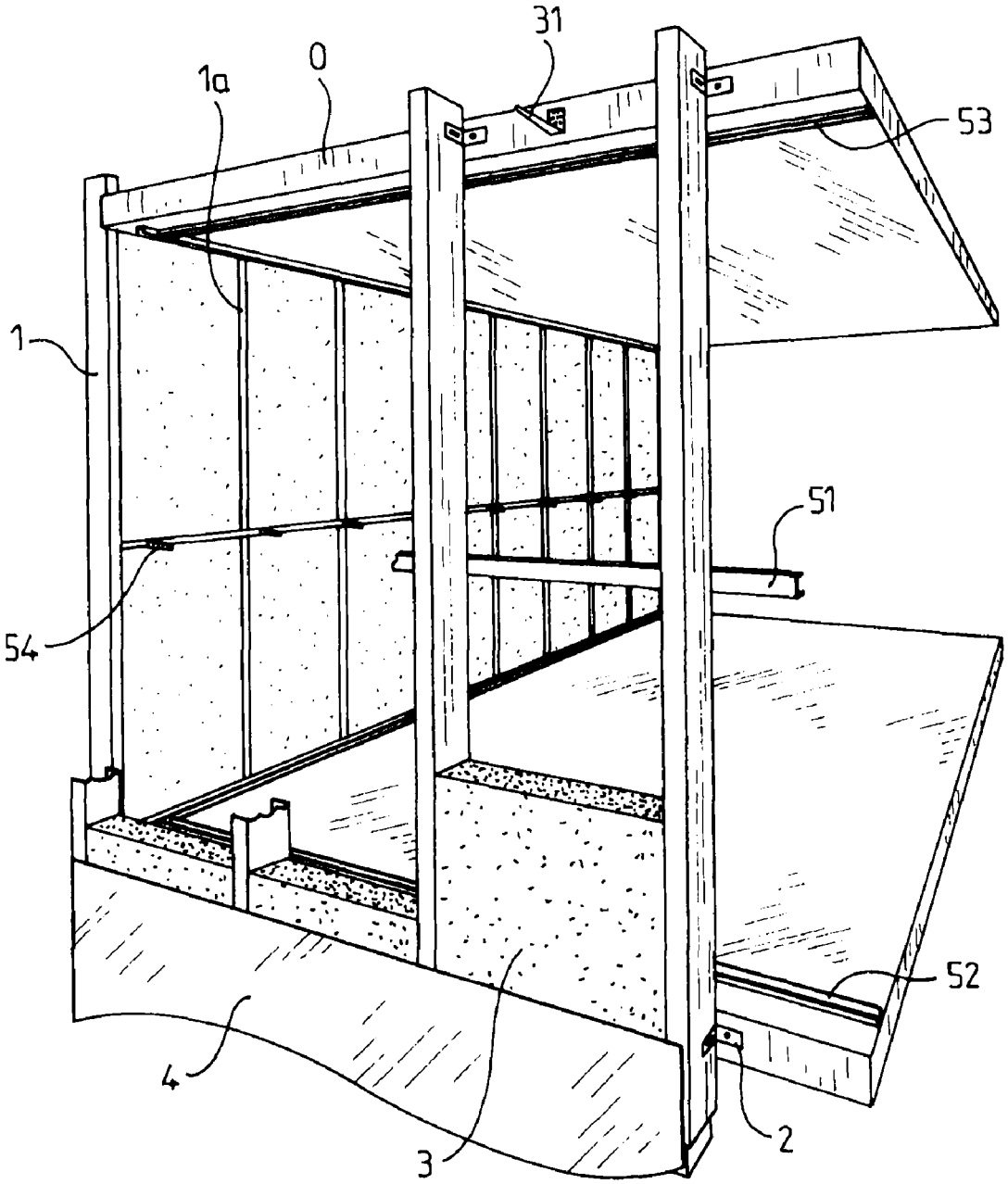

Referring to FIG. 4, horizontal rails 51 are fixed to said flat rear surfaces 1*a* of the profiled elements 1. A quick gun-riveting process can be used.

The rails 51 are metal U profiled elements with perpendicular flanges. On this subject, and in the rest of the description of the interior insulation, application WO 2006/061538 is also referred to.

Also fixed to the floor edges 0 are bottom tracks 52 and top tracks 53. The distance between these and said flat rear surfaces 1*a* is chosen so that the lining sheets of the interior insulation rest against the bottom tracks 52 and top tracks 53.

Contact and spacer elements 54 are then fixed into the horizontal rails 51, each time for example by a certain elastic deformation of the rails.

Figure 5:
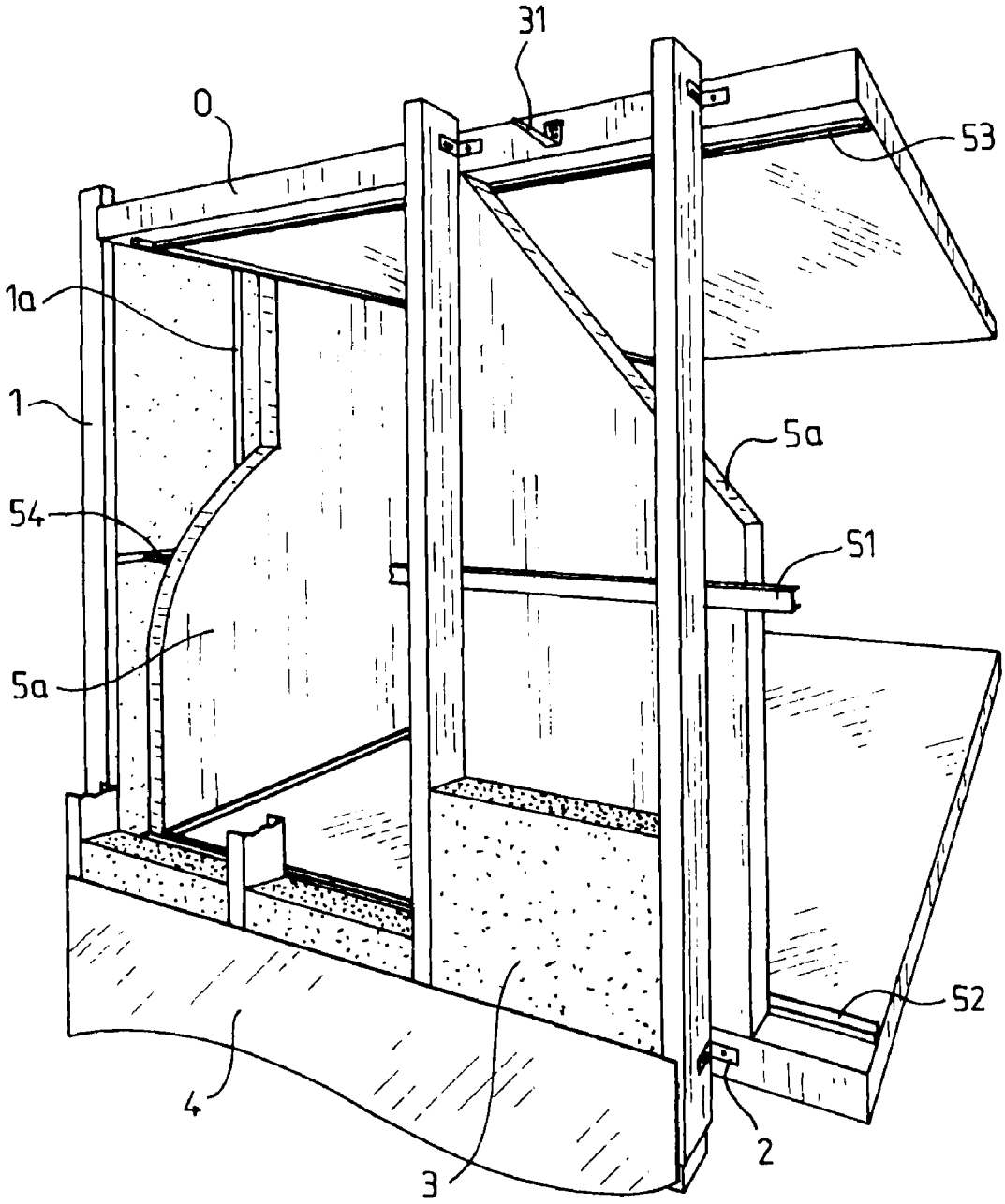

As seen in FIG. 5, an insulating element 5*a* is stuck onto the contact and spacer elements 54. The insulating element 5*a* is then positioned in contact with the flat rear surfaces 1*a* of the profiled elements 1 and with the horizontal rails 51, behind the bottom tracks 52 and top tracks 53.

The insulating element 5*a* is a glass wool whose thickness may be chosen anywhere between 80 and 120 mm, and with a thermal conductivity of 0.032 W/mK from Saint-Gobain Isover under the name Isoconfort 32.

Figure 6:
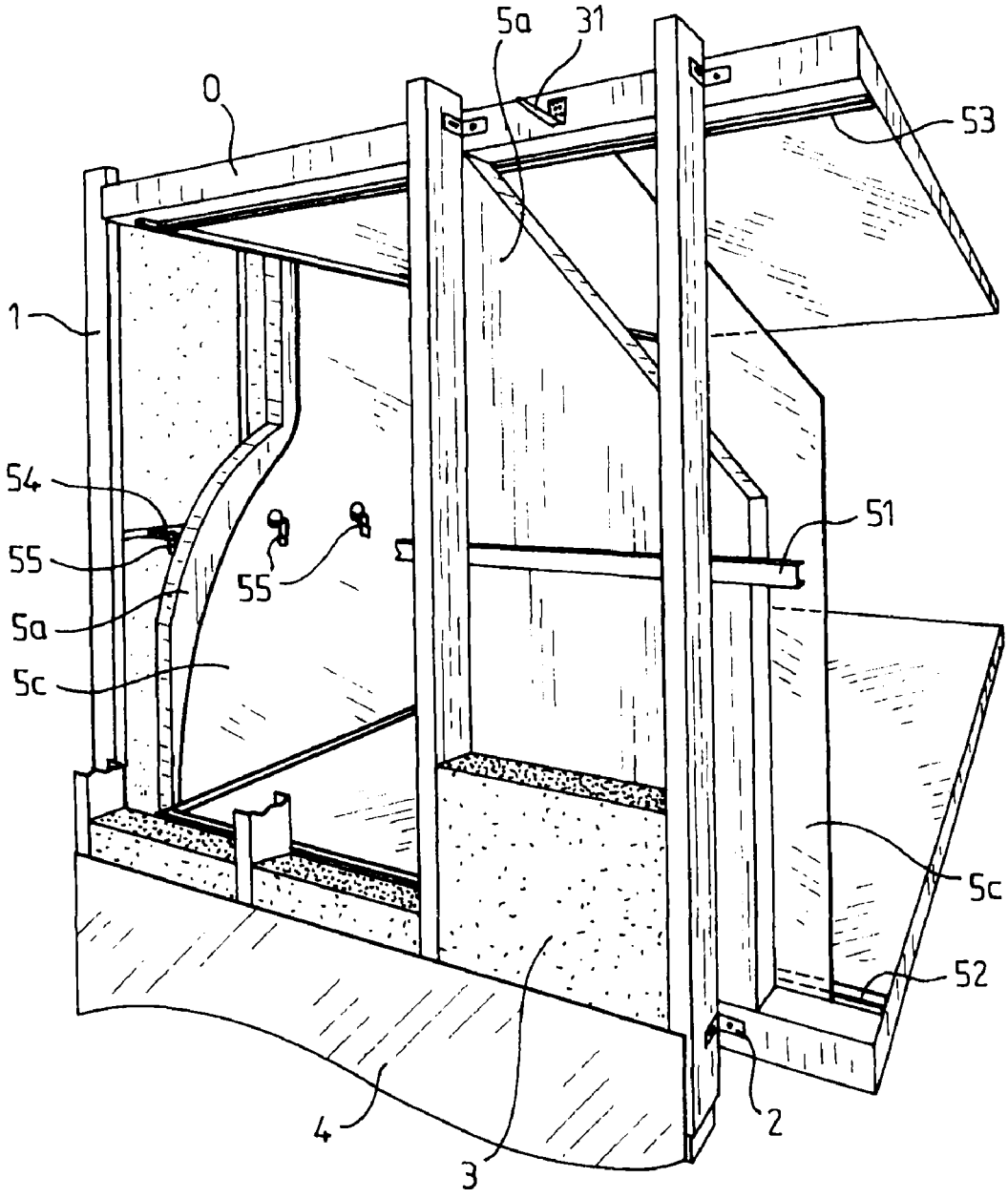

Rail holding elements 55 are then attached to the contact and spacer elements 54—FIG. 6.

Figure 7:
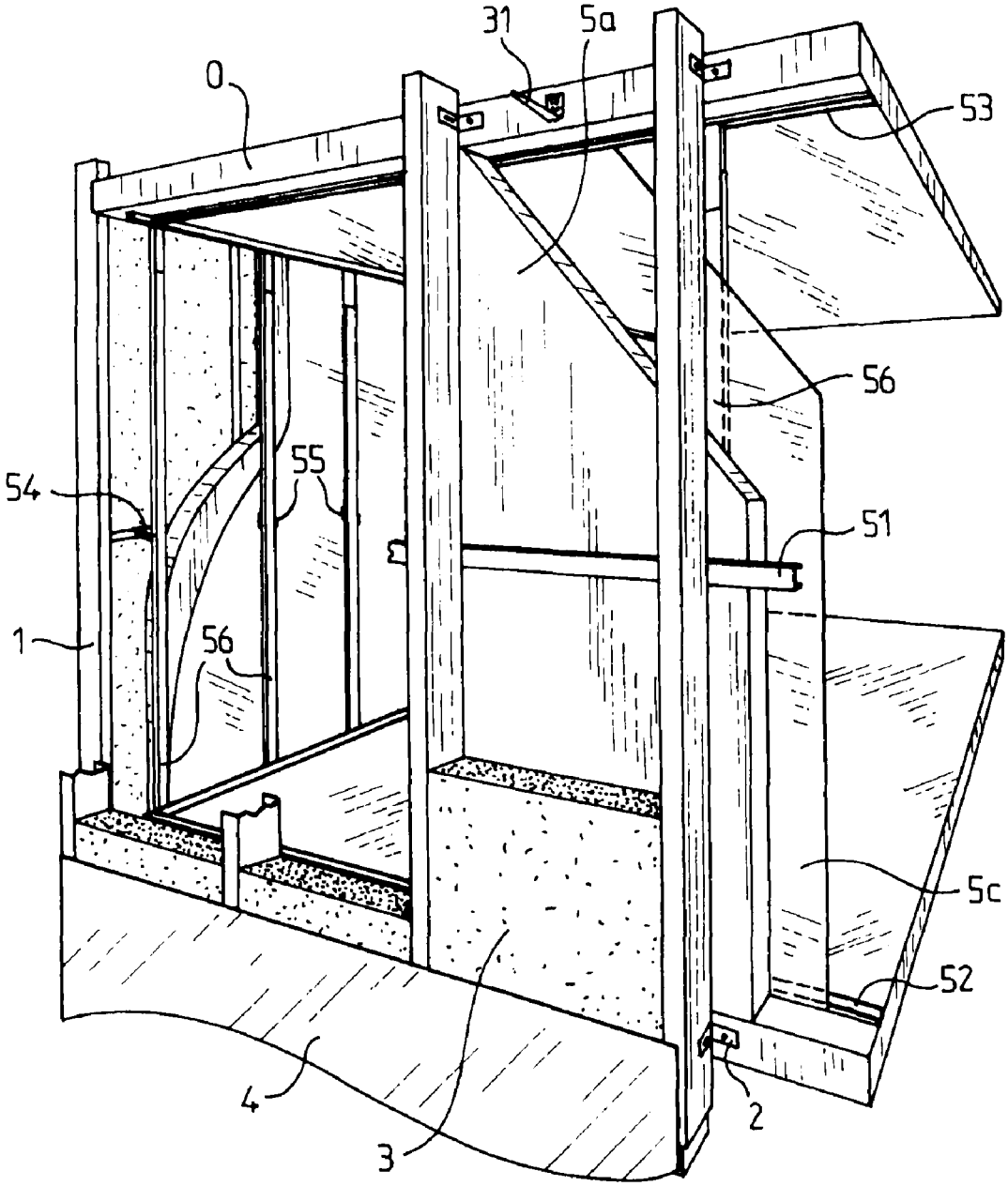

Then, as shown in FIG. 7 vertical rails 56 are fixed to the holding elements 55. The rails 56 are positioned behind the bottom tracks 52 and top tracks 53.

The vertical rails 56, like the horizontal rails 51, are metal U profiled elements with perpendicular flanges. The holding elements 55 engage with the contact and spacer elements 54 in such a way as to allow easy adjustment of their position so that they are perpendicular to the facade and can then be locked. They also engage with the vertical rails 56, fixing them in the desired position perpendicular to the facade.

A vapor barrier 5*c* is applied to the flat back of the rails 56.

The vapor barrier is advantageously a moisture regulating membrane marketed under the name Vario by Saint-Gobain Isover. A standard vapor barrier may consist of a 100 to 200 μm thick polyethylene sheet, for example.

Figure 8:
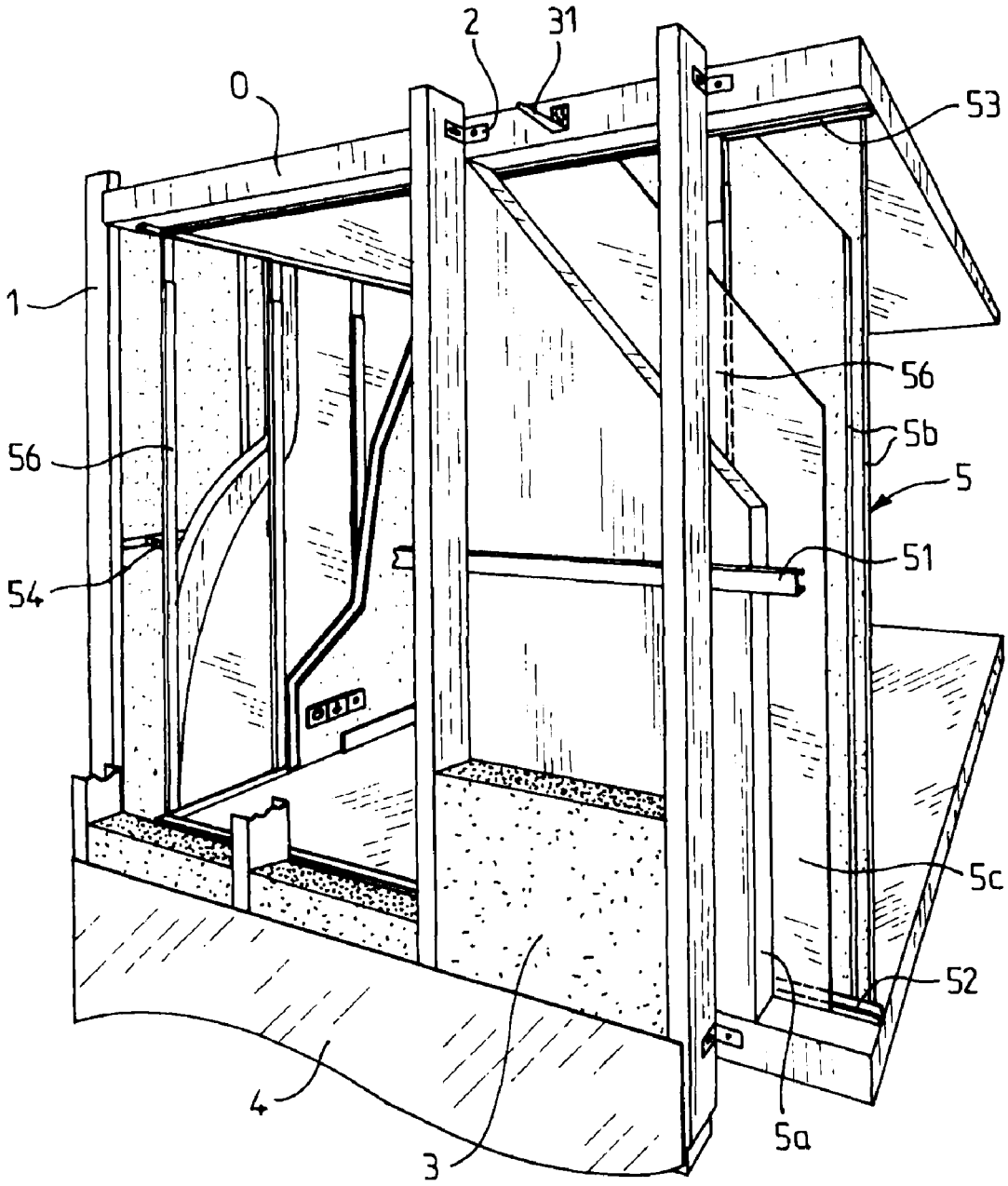

As shown in FIG. 8, two sheets of 13 mm thick plasterboard or one sheet of 25 mm thick plasterboard 5*b* is fixed to the vertical flat surface formed by the vertical rails 56 and the bottom 52 and top 53 tracks.

Numerous variants are possible for installing the second insulating element 5*a*, the vapor barrier 5*c* and the interior lining 5*b*.

In particular, the combination made up of the horizontal rails 51, the contact and spacer elements 54, the holding elements 55 and the vertical rails 56 can easily be replaced.

Thus, it is possible to fix spikes 31 as described above, to that face of the profiled elements 1 which is toward the building interior, to allow the second insulating element 5*a* to be skewered to it and retained on it. Alternatively, the function of such spikes 31 may be performed by vertical profiled elements (such as U elements) fixed to that face of the profiled elements 1 which is toward the building interior, between two floors.

The vapor barrier 5*c* can be applied on top of the spikes 31 or on top of the vertical U profiled elements.

In front of the vapor barrier 5*c*, uprights M 36 to French standard NF DTU 25.41 can be fixed in runners R 36 to the same standard, from the floor and ceiling, back to back (in pairs) in a vertical position. These uprights M 36 are U profiled elements. The volume corresponding to the depth of these uprights is left empty (air gap).

Two sheets of BA 13 type plasterboard 5*b* (or a single sheet of BA 25) are fixed to the uprights M 36.

In this embodiment the fixings of the plasterboard sheets 5*b* are independent and not connected to the profiled elements 1.

The resulting facade meets the standards for mechanical strength and is easy to dismantle. It provides excellent thermal and acoustic insulation. No masonry or equivalent wall is required between the first or exterior insulating material and the second or interior insulating material between floors.

The invention claimed is:

1. A building facade comprising:

an exterior envelope comprising facade elements;

a rain barrier;

profiled elements fixed vertically to floor edges, wherein each profiled element includes a flat rear surface;

a thermal insulation system comprising a first insulating element in front of the floor edges and an interior insulation system including a second insulating element that is vertically disposed between floors and inwardly of the floor edges;

a vapor barrier; and an interior lining, wherein the first insulating element is substantially continuous across the surface of the facade, essentially free of air pockets, wherein two adjacent breadths of the first insulating element are separated by a flat side surface of the profiled elements projecting outwardly of the floor edges, wherein each flat rear surface is attached to at least one floor edge and in contact with or attached to the interior insulation system, wherein the exterior envelope, the rain barrier, the profiled elements and the first insulating element, the second insulating element, the vapor barrier, and the internal lining are arranged in succession.

2. The building facade as claimed in claim 1, wherein the profiled elements include:

a flat front surface that supports and attaches to the rain barrier and the facade elements, wherein the flat side surface joins the flat rear and front surfaces.

3. The building facade as claimed in claim 1, wherein the profiled elements are formed as at least one of H, C, U, or Z shaped elements.

4. The building facade as claimed in claim 1, wherein the profiled elements are made of reinforced plastic.

5. The building facade as claimed in claim 1, wherein the profiled elements are made of pultruded resin and glass fiber composite, which may be continuous or in a form of mats.

6. The building facade as claimed in claim 1, wherein the first and second insulating elements are formed by at least one of inorganic fiber-based insulating materials, glass wool, rock wool, plant fibers, hemp, flax, cotton wool, fibers of animal origin, and sheep's wool.

7. The building facade as claimed in claim 1, wherein the interior lining is based on a plasterboard sheet or multiple superposed plasterboard sheets.

8. The building facade as claimed in claim 1, further comprising:

a first set of tracks on the top of each of the floors and disposed inwardly of the floor edges;

a second set of tracks on the bottom of each of the floors and disposed inwardly of the floor edges;

horizontal rails fixed to the profiled elements, wherein the second insulating element contacts the profiled elements and horizontal rails and is positioned outwardly of the first set of tracks and the second set of tracks.

9. The building facade as claimed in claim 1, wherein the breaths of the first insulating element are held in position by spikes fixed to and extending outwardly from the floor edges.

10. An assembly for making a building facade, comprising:

facade elements;

a rain barrier;

profiled elements and means for fixing the profiled elements vertically to floor edges with a gap between the profiled elements and the floor edges;

a thermal insulation system comprising a first insulating element placed outwardly and in front of the floor edges and a second insulating element placed vertically between floors, inwardly of the floor edges, and adjacent to the first insulating element and a flat rear surface of the profiled elements;

a vapor barrier; and an interior lining, the profiled elements receive the first insulating element in a layer that is substantially continuous across the surface of the facade and essentially free of air pockets, the profiled elements having a flat side surface that projects outwardly of the floor edges and separates two adjacent breadths of the first insulating element wherein the facade elements, the rain barrier, the profiled elements and the first insulating element, the second insulating layer, the vapor barrier, and the internal lining are assembled in succession.

11. The building facade as claimed in claim 8, further comprising:

spacer elements fixed to the horizontal rails, wherein the second insulating element is placed on the spacer elements.

12. The building facade as claimed in claim 10, wherein the second insulating element forms part of an interior insulation system and the flat rear surface of each of the profiled elements is attached to one of the floor edges and supports or is attached to the interior insulation system.

* * * * *

UNITED STATES PATENT AND TRADEMARK OFFICE

CERTIFICATE OF CORRECTION

PATENT NO. : 8,250,820 B2
APPLICATION NO. : 12/808825
DATED : August 28, 2012
INVENTOR(S) : Laurent Joret et al.

It is certified that error appears in the above-identified patent and that said Letters Patent is hereby corrected as shown below:

On the title page, Item (73), the Assignee's name is incorrect. Item (73) should read:

-- (73) Assignee: Saint-Gobain Isover, Courbevoie (FR) --

Signed and Sealed this
Sixth Day of November, 2012

David J. Kappos

David J. Kappos
*Director of the United States Patent and Trademark Office*